United States Patent [19]

Kreitz

[11] 4,185,523

[45] Jan. 29, 1980

[54] FLOATING PLIERS

[76] Inventor: Lloyd D. Kreitz, P.O. Box 60, Pequot Lakes, Minn. 56472

[21] Appl. No.: 911,387

[22] Filed: Jun. 1, 1978

[51] Int. Cl.[2] ..... B25B 7/02
[52] U.S. Cl. ..... 81/417
[58] Field of Search ..... 81/415, 417, 428; 30/261; 267/153; 7/106; 43/53.5

[56] References Cited

U.S. PATENT DOCUMENTS

| | | | |
|---|---|---|---|
| 81,717 | 9/1868 | Weston | 81/417 |
| 526,479 | 9/1894 | Bernard | 81/428 R |
| 1,629,583 | 5/1927 | Nelson | 43/53.5 |
| 2,853,400 | 9/1958 | Ahlbin | 117/65 |

*Primary Examiner*—James L. Jones, Jr.
*Attorney, Agent, or Firm*—Richard E. Brink

[57] ABSTRACT

A pair of pliers, having particular utility for removing a hook swallowed by a fish, is rendered buoyant by affixing a block of closed cell polymeric foam between the inner aspects of the handles.

6 Claims, 5 Drawing Figures

FLOATING PLIERS

BACKGROUND OF THE INVENTION

This invention relates to pliers, especially long-nosed pliers of the type useful for removing a hook swallowed by a fish.

A common problem encountered by most persons who fish is that of removing a hook after it has been swallowed by a fish. It is not only extremely difficult to grasp the hook, but it is often dangerous to do so with one's bare hands, especially if the fish is a muskellunge, northern pike or other species having numerous needle-sharp teeth. Many people have found it convenient to carry a pair of long-nose pliers to assist in removing hooks which a fish has swallowed, but in an annoying number of cases the pliers fall overboard and are lost. Additionally, it is sometimes inconvenient to open the jaws of the pliers, especially with one hand.

SUMMARY

The present invention provides a pair of pliers which is light weight; indeed, the pliers are provided with a means for keeping them afloat if they inadvertently fall into the water. The pliers are so constructed that the normal position of the jaws is slightly spaced apart, so that they can readily slip over a hook. The handles of the pliers can then be squeezed together, thereby gripping the hook firmly so that it can readily be extracted from the fish.

In its simplest aspect the invention comprises inserting a block of resilient, light weight closed cell foam between the handles of the pliers, thereby reducing the effective density of the composite tool to less than that of water. The block of foam is dimensioned so that the jaws of the pliers are slightly spaced apart; in order to keep the jaws from opening too widely and thus making it inconvenient to grip the handles, the block of foam is preferably adhered or otherwise attached to the handles. The resilient nature of the foam causes the jaws of the pliers to separate slightly as soon as the handles are no longer being squeezed, thus readying the tool for its next use.

BRIEF DESCRIPTION OF THE DRAWING

Understanding of the invention will be enhanced by reference to the accompanying drawing, in which like numbers refer to like parts in the several views and in which.

DESCRIPTION OF PRESENTLY PREFERRED EMBODIMENT

Figure 1:
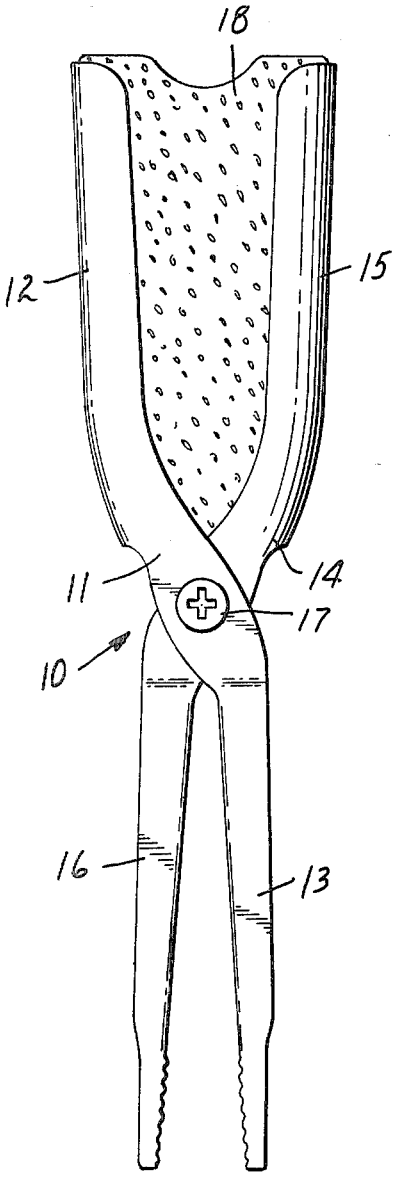
FIG. 1 is a side view of the pliers of the invention in their normal position.

As a further aid to understanding the invention, a preferred but illustrative embodiment of the invention will now be described in greater detail.

In the drawings, pliers 10 comprise members 11 and 14, each having a generally channel-shaped cross-section, are connected by rivet or bolt 17, which serves as a fulcrum. The central portion of member 11 is slightly wider in cross-section than the central portion of member 14, permitting the latter to be inserted through the former. Member 11 comprises handle 12 and jaw 13, while member 14 similarly comprises handle 15 and jaw 16. The channel-shaped cross-section of members 11 and 12 permits them to have excellent strength for their weight. It is contemplated that members 11 and 12 will be made out of aluminum, further contributing to their relatively low weight and additionally contributing rust-resistance to the pliers.

Figure 2:
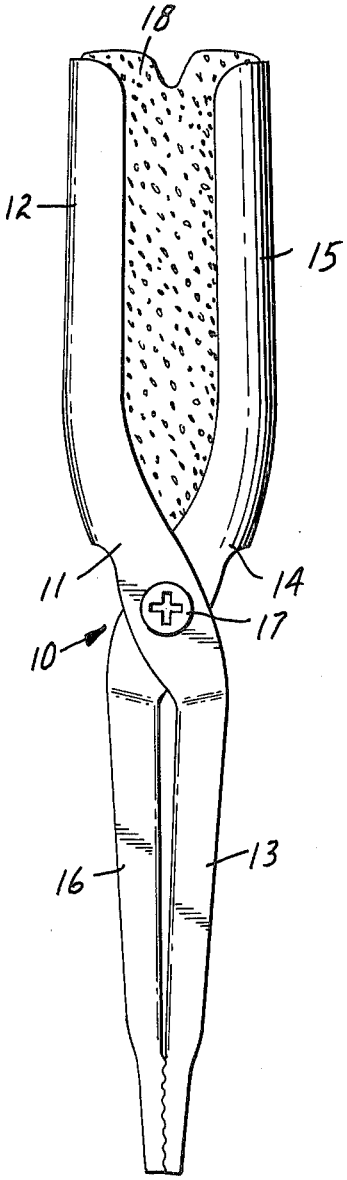
FIG. 2 is a side view of the pliers of FIG. 1, showing them in closed position.
Figure 3:
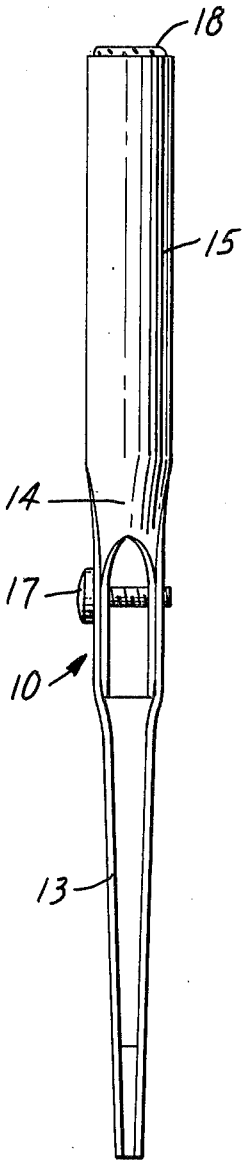
FIG. 3 is a right edge view of the pliers of FIG. 1.

Interposed between handles 12 and 15 is a block of resilient closed-cell polymeric foam 18. The dimensions of foam block 18 are selected so that jaws 13 and 16 are normally spaced slightly apart; additionally, the dimensions of foam block 18 are sufficiently great that the effective overall density of pliers 10 is less than that of water, thereby rendering the tool light enough to float. As is shown particularly in FIG. 2, foam block 18 compresses when handles 12 and 15 are squeezed together; removal of the squeezing pressure, however, causes handles 12 and 15 to spring apart, returning the pliers to the position shown in FIG. 1.

While many polymeric foams can probably be used, it is essential that any such foam be closed-cell, water-resistant and of low density. One satisfactory foam is an odorless, light-weight polyethylene product having approximately 1/30 the density of water such as that available from Dow Chemical Company under the trade designation "Ethafoam." It is contemplated that a compressible polyurethane foam could be substituted and that such a foam could possess the resilient qualities also displayed by the polyethylene product.

It is desirable that foam block 18 be affixed to handle 12, handle 15 or both, not only so that it will not inadvertently fall out but also so that handles 12, 15—and simultaneously, of course, jaws 13, 16—are not separated too far. For this purpose, block 18 may either be adhered to the inner aspects of handles 12 and 15 or be held in place by punching in tabs from handles 12 and 15 to penetrate and grip block 18.

Figure 5:
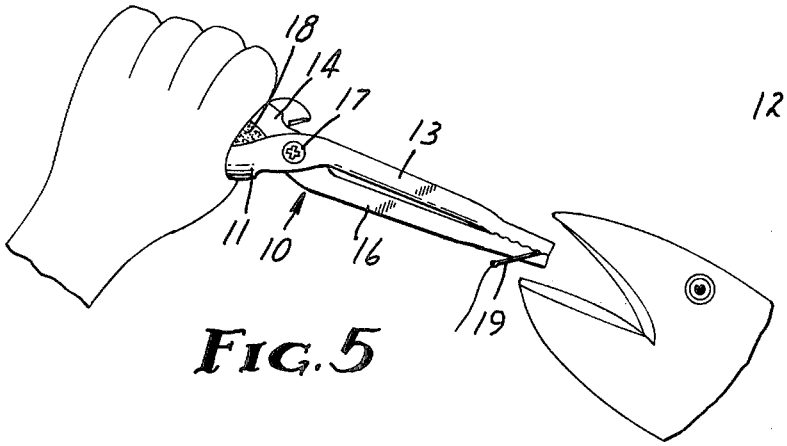
FIG. 5 shows how the pliers of FIG. 1 may be used to remove a hook swallowed by a fish.
Figure 4:
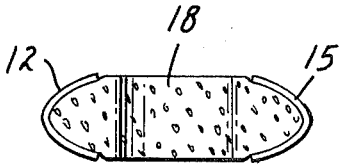
FIG. 4 is a view of the pliers of FIG. 1, taken from the handle end.

While specific dimensions of the component parts of pliers 10 are not critical, it is preferred to have jaws 13, 16 long enough that they can be inserted deep into the throat of a fish to grip a hook 19, as indicated generally in FIG. 5. To enhance the ease of grasping hook 19, the tips of jaws 13, 16 may be serrated, knurled or otherwise roughened.

Those skilled in the art will appreciate that numerous variations of the device just described can be made without departing from the spirit of the invention. Accordingly, the scope of the invention is determined only by the claims.

I claim:

1. A pair of pliers capable of floating in water and hence having particular utility for use in fishing operations such as removing the hook from the throat of a fish, comprising in combination:

a pair of members, each comprising a handle portion, a jaw portion and an intervening central portion, said members pivotally connected at their central portions, and a block of light weight closed-cell resilient foam substantially filling the space between said handle portions and connected to both of them therebetween

2. The pliers of claim 1 wherein each of said members has a generally channel-shaped cross-section, the opposed handle portions presenting the open edge of such channel.

3. The pliers of claim 1 or 2 wherein the normal position of said jaw portions is spaced slightly apart from each other, thereby facilitating their ability to slip over a hook.

4. The pliers of claim 1 or 2 wherein the foam is formed of polyethylene and has a density approximately 1/30 that of water.

5. The pliers of claim 1 or 2 wherein the members are both formed of aluminum.

6. The pliers of claim 1 or 2 wherein the dimensions and density of the foam block are chosen so that the effective density of the pliers is less than that of water.

* * * * *